US009662555B2

(12) United States Patent
Rickard

(10) Patent No.: US 9,662,555 B2
(45) Date of Patent: May 30, 2017

(54) MULTI-HOOP BASKETBALL SHOT TRAINING APPARATUS AND METHODS

(71) Applicant: Rodger Rickard, Woodside, CA (US)

(72) Inventor: Rodger Rickard, Woodside, CA (US)

( * ) Notice: Subject to any disclaimer, the term of this patent is extended or adjusted under 35 U.S.C. 154(b) by 53 days.

(21) Appl. No.: 14/604,356

(22) Filed: Jan. 23, 2015

(65) Prior Publication Data

US 2015/0231466 A1 Aug. 20, 2015

Related U.S. Application Data

(60) Provisional application No. 61/933,114, filed on Jan. 29, 2014, provisional application No. 62/016,276, filed on Jun. 24, 2014.

(51) Int. Cl.
*A63B 63/08* (2006.01)

(52) U.S. Cl.
CPC ..... *A63B 63/083* (2013.01); *A63B 2225/09* (2013.01); *A63B 2243/0037* (2013.01)

(58) Field of Classification Search
CPC ..... A63B 63/083
See application file for complete search history.

(56) References Cited

U.S. PATENT DOCUMENTS 2,230,813 A 2/1941 Pressman
2,976,002 A * 3/1961 Green ..... B65G 69/00 193/16
4,358,083 A 11/1982 Haubrich
5,207,789 A 5/1993 Gates
5,308,059 A 5/1994 Owen, Jr.
5,364,092 A 11/1994 Riepe et al.
5,730,667 A * 3/1998 Jones ..... A63B 63/083 473/447
6,648,717 B1 11/2003 Dignitti et al.
6,913,551 B1 7/2005 Foley
(Continued)

*Primary Examiner* — Gene Kim
*Assistant Examiner* — Jeffrey Vanderveen
(74) *Attorney, Agent, or Firm* — Bay Area Technology Law Group PC

(57) ABSTRACT

An apparatus for improving the accuracy of a basketball shooter is disclosed. Rim attachments can have either a regulation 18' diameter mounted thereon or rims having smaller diameters such as 16". By practicing with smaller diameter rims a shooter must increase the ball trajectory to put the ball through the smaller diameter rims. As his accuracy improves with the smaller diameter rims, his accuracy improves even more with a full size rim. Rim attachments must be easy to interchange and must be very secure over prolonged usage. An adapter is provided for engaging and securing rim attachments with rim diameters of standard size or smaller. An adapter has a flat base plate which is secured to a basketball backboard. It is provided with a sleeve at the bottom. A pair of opposing locking pins is each mounted at the top of the adapter. The locking pins are withdrawn to allow a rim attachment bracket to be lodged within the sleeve and the pins are extended to lock in the attachment bracket when in place. A pair of pin stops are formed on the rim attachment bracket below the rim such that when the rim attachment bracket is in place within the sleeve the pin stops are located directly below the extended locking pins to prevent any vertical movement of the rim attachment and rim.

3 Claims, 8 Drawing Sheets

(56) References Cited

U.S. PATENT DOCUMENTS

| | | | | |
|---|---|---|---|---|
| 6,932,723 | B1 | 8/2005 | Klinger et al. | |
| 6,935,966 | B2 | 8/2005 | Kershaw | |
| 7,175,551 | B1 * | 2/2007 | Hamilton | A63B 63/083 473/486 |
| 7,402,116 | B2 | 7/2008 | Zuccarini et al. | |
| 8,251,842 | B2 | 8/2012 | Heflin, Sr. | |
| 2003/0057650 | A1 | 3/2003 | Carter | |
| 2004/0043841 | A1 | 3/2004 | Williams | |
| 2007/0082759 | A1 * | 4/2007 | Burkhardt | A63B 63/083 473/448 |
| 2011/0312448 | A1 | 12/2011 | Mcilvain et al. | |

* cited by examiner

MULTI-HOOP BASKETBALL SHOT TRAINING APPARATUS AND METHODS

This application is related to and based upon two provisional patent applications, the first filed Jan. 29, 2014, application No. 61/933,114, and the second filed on Jun. 24, 2014, application No. 62/016,276, both by the same inventor as this utility patent application and hereby claims the dates of priority of both provisional applications.

BACKGROUND OF THE INVENTION

1. Field of the Invention

The present invention relates to a device and method of improving the shooting accuracy of a basketball player.

2. Description of Prior Art

There have been many attempts to provide various gadgets or fixtures to help basketball players improve the accuracy of their shooting. Many of these practice devices involve modifications to the basketball rim itself that are ineffective because they distort the image of the basketball rim or backboard. Thus, a basketball player attempting to shoot at a regulation basketball rim sees something entirely different than the practice device.

It should be noted that the regulation basketball rim or hoop has a diameter of 18 inches. A regulation size basketball has a spherical diameter of 9 inches. Using these dimensions it can be seen that two balls could pass through the rim at the same time if the trajectory of the balls were exactly vertical. There is no margin for error in this example. However, if only one ball was passing through the hoop in a strictly vertical decent, the margin of error for the shooter is increased 100%.

In practice, to be a good shooter with high accuracy, a basketball must be lofted at a trajectory which, as the ball approaches the rim from above, is at an angle of at least 45% to the plane defined by the basketball rim, when shooting directly at the basket and not banking a shot off of the backboard. Below about 45% the effective area that the basketball can pass through the rim is lowered. For example, a ball approaching the rim from above at an angle in the range of 5% to 10% has little chance to go through the hoop. As the angle increases, the effective area which the basketball "sees" increases and the more likely the ball will go through the hoop. Above 45% the effective area increases but the basketball must have a much higher trajectory and the ball has to travel farther, thereby reducing accuracy.

A very effective approach to help a player increase his accuracy is to substitute hoops with smaller than regulation diameters. To shoot the ball through a rim with a reduced diameter in effect forces a player to shoot the ball at an optimum trajectory angle discussed above. If the hoops are identical except for their diameters, from a players standpoint, it looks like they are shooting at a regulation diameter rim.

By using a smaller practice rim (14"-16"), the shooter's margin of error will be decreased and will require the player to have an increased level of concentration and focus to make the shot. The practice results will increase the shooter's margin of error and subsequently improve their muscle memory, confidence and shooting percentage because they are replicating the higher arc on the larger regulation rim (18").

To be practical rims of different diameters must be easily interchangeable. For example, if each rim with a different diameter must be bolted separately to the back board and then unbolted and replaced with a rim of another diameter, this takes a lot of time and labor and is not an effective approach. In other words, the time consuming process of installing and transferring the differing sizes of rims to the backboard becomes a factor in use time spent making the change.

In one prior art approach, the plate to which the rim is secured is simply inserted into a pocket mounted on the backboard. This approach has several disadvantages. First, the hoop is not firmly secured and will tend to rattle and vibrate when a basketball strikes the rim. Second, with time and with basketballs continuously striking the hoop, the rim can move vertically and laterally tending to wear out the pocket, causing rattling and causing the rim to move from its regulation 10 foot height.

SUMMARY OF THE INVENTION

Embodiments of the present invention relate to improving basketball shooting accuracy through the use of a training apparatus and methods of using, securing and interchanging the training apparatus. In particular, the apparatus is directed towards the use of at least one, or preferably two basketball hoops that can be interchangeably attached to a backboard to replace a standard basketball hoop or rim. As an example one may have three hoops with three different diameters. The first hoop is the size and shape of a game regulation basketball hoop which is 18" in diameter. In contrast, the second and third hoops have slightly smaller diameters than the first hoop, for example 16" and 14", but are otherwise virtually indistinguishable from a game regulation basketball hoop.

Prior attempts by others to provide an interchangeable basketball hoop of a different size to a backboard have resulted in a visual distortion of the hoop and backboard and did not exactly duplicate the image the shooter would normally see. This distraction is eliminated by using a quick change adapter that is attached to the backboard. This makes the hoop or rim attachments, whether regulation or practice rims, a easily interchangeable. The change can be done by a coach or player in a few minutes time without needing tools at hand and a ladder. Many backboard/rim combinations are self-supporting from the ground and are easily lowered to change a rim diameter with no ladder necessary It is extremely important that the rims be very securely attached to the backboard. Of course, each diameter rim could be bolted to a backboard but this is a very time-consuming and impractical approached. Nor are rims that have brackets that drop into pockets mounted to the backboard suitable in this regard. They are not securely held in place and are subject to vibrations and vertical movements with repeated use.

In accordance with the present invention, rims of a regulation 18" diameter as well as rims with smaller than standard diameters are secured to attachment brackets. The attachment brackets are at a right angle to the rims.

An adapter is provided for engaging and securing rim diameters of standard or smaller diameter sizes. The adapter has a flat baseplate with openings allowing it to be secured to basketball backboards with different mounting arrangements. The adapter has a sleeve that has a top opening. It is secured to and separated from the bottom of the flat baseplate. It is formed by two vertical sides and one horizontal side spaced apart on the baseplate, the sleeve being adaptable to receive and secure a rim attachment bracket.

A pair of opposing locking pins are formed or welded at the near the top of the adapter baseplate. The pins are withdrawn to allow a rim attachment bracket to be lodged within the sleeve. The pins are extended to lock in the attachment bracket when in place. In the preferred embodiment the locking pins are circular in cross section but can have cross sections with other shapes such as square or rectangular Importantly a pair of pin or rim stops on the rim attachment bracket below the rim and such that when the rim attachment bracket is in place within the sleeve the pin stops are located directly below the locking pins when inserted within the adapter. This further secures the rim attachment bracket and prevents any vertical movement of the rim attachment bracket and rim even after extended use. In the preferred embodiment the pin stops have a circular cross section but they may also have square or rectangular cross sections.

BRIEF DESCRIPTION OF THE DRAWINGS

These and other features of the present invention will be described in more details below in the detailed description of the invention and in conjunction with the following figures.

DETAILED DESCRIPTION OF THE PREFERRED EMBODIMENTS

Figure 1:
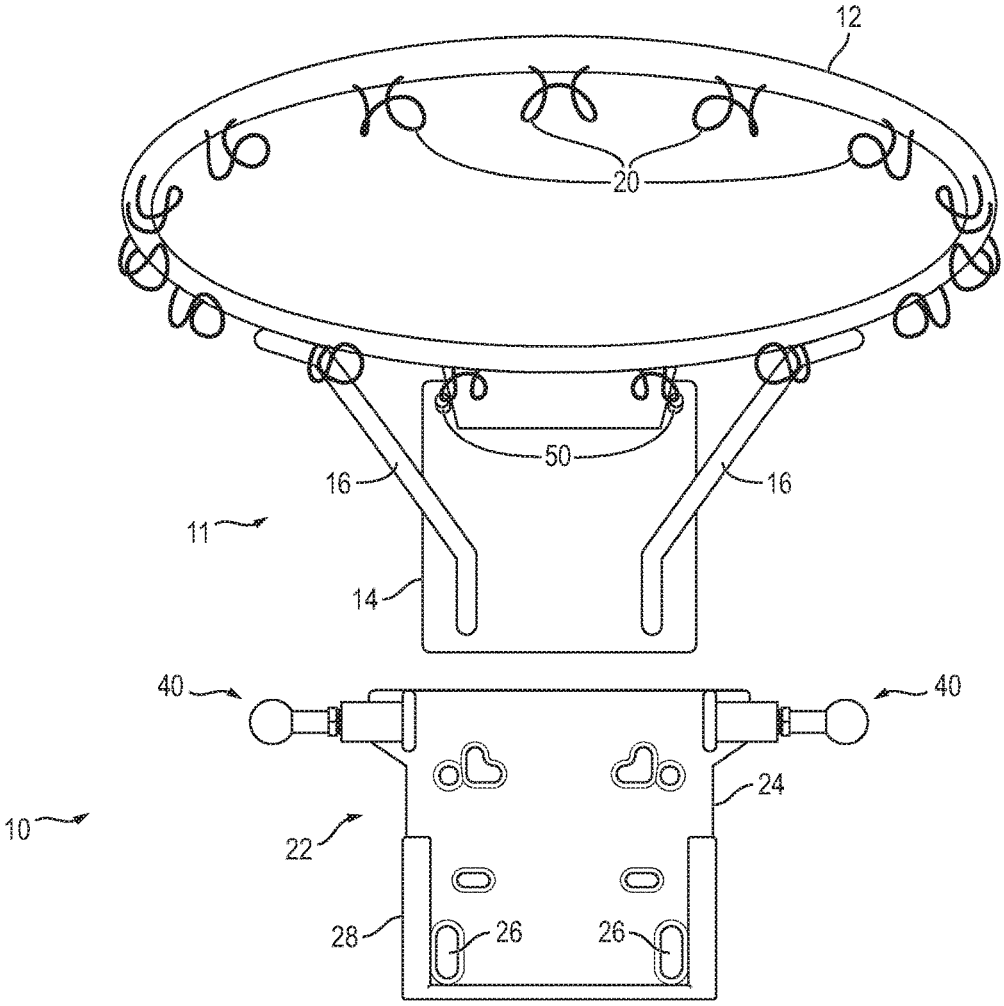
FIG. 1 is a front view illustrating the rim attachment prior to being inserted within the adapter, in accordance with the invention.

The present invention will now be described in detail with reference to a few preferred embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details.

Multiple-hoop basketball shooting training apparatus is used to train basketball players to have higher basketball shot accuracy. In one embodiment, players when training are exposed to a basketball hoop that looks similar to the appearance of a regulation basketball hoop but has a smaller diameter compared with a regulation 18" hoop. Since a smaller diameter results in a smaller area for the basketball to pass through, it is more difficult to accurately shoot a basketball through the basketball hoop having the smaller diameter. To successfully throw the basketball through a rim with a smaller rim diameter the shooter must put the proper arc on his shot. This is in the order of about 45 degrees to the plane of the rim, as explained above.

In one experiment, a first regulation-sized basketball hoop was replaced with a slightly smaller basketball hoop that looked substantially similar to a regulation basketball hoop when viewed by players. The second, smaller hoop had a diameter of only 16" which is two inches smaller than the diameter of a regulation hoop. In this example, the players were not aware that the basketball hoops had been changed from the regulation-sized basketball hoops to the smaller-diameter basketball hoops, and initially the shooting percentage of the players was noticeably lower. In other words, when players attempted to shoot basketballs through the smaller hoops, their shooting percentage noticeably dropped.

This phase of the experiment lasted approximately a week before the players faced an opponent in a regulation game. When the trained basketball players switched from the smaller diameter basketball hoop back to a regulation-sized basketball hoop, the shooting percentages of the players increased dramatically with respect to their former shooting percentages. In other words, the use of the smaller basketball hoop for the purposes of training resulted in the players achieving a higher shooting percentage than demonstrated previously. Additionally, since the trained basketball players found that it was not apparent upon casually viewing a basketball hoop whether the hoop was regulation-sized or a hoop having a slightly smaller circumference, the players were able to consistently shoot the basketball along an optimum trajectory at the regulation-sized hoops in the same way that they were forced to shoot the basketball to successfully put the ball through the hoop in the slightly smaller basketball hoop, e.g., by launching the ball with a sufficiently high trajectory.

As such, the use of smaller hoops that are effectively indistinguishable from a regulation-sized basketball hoop provides a benefit of allowing players to train on smaller diameter hoops while simulating conditions of a regulation basketball game. Accordingly, the practice hoops are designed to look substantially identical to a regulation rim with the reduced diameter of their rims.

But to have a practical and durable multi-hoop basketball apparatus it is extremely important that hoops of different size diameters be exchanged easily with minimum labor, and that the rims be attached in such a way that they are held securely in place and do not move upwardly or vertically even with extended use.

FIG. 1 illustrates the major components of the basketball training apparatus 10 of the present invention. A rim attachment 11 has a rim or hoop 12 mounted to a rim attachment 14 by support members 16 typically welded at the bottom of each to the rim base plate 14 and at their tops to the rim 12. A pair of pin or rim stops 50 are welded below the rim 12. The function of these pin stops 50 will be explained in conjunction with FIGS. 6-10. The rim 12 has a plurality of hooks which are used to hold and suspend a net (not shown).

The second component of the basketball training apparatus 10 is the adapter 22. The adapter 22 is adapted to easily insert, secure and exchange rim attachments 11, which in turn may have regulation 18 inch diameter hoops or smaller diameter hoops for training. The adapter 22 has a flat baseplate 24 with a plurality of openings to be bolted to a basketball backboard with a variety of different mounting configurations. However, once mounted to a backboard, the attachment plate remains secured to the backboard and interchanging of rim attachments are carried out with the adapter 22 in place and mounted to the backboard.

Figure 2:
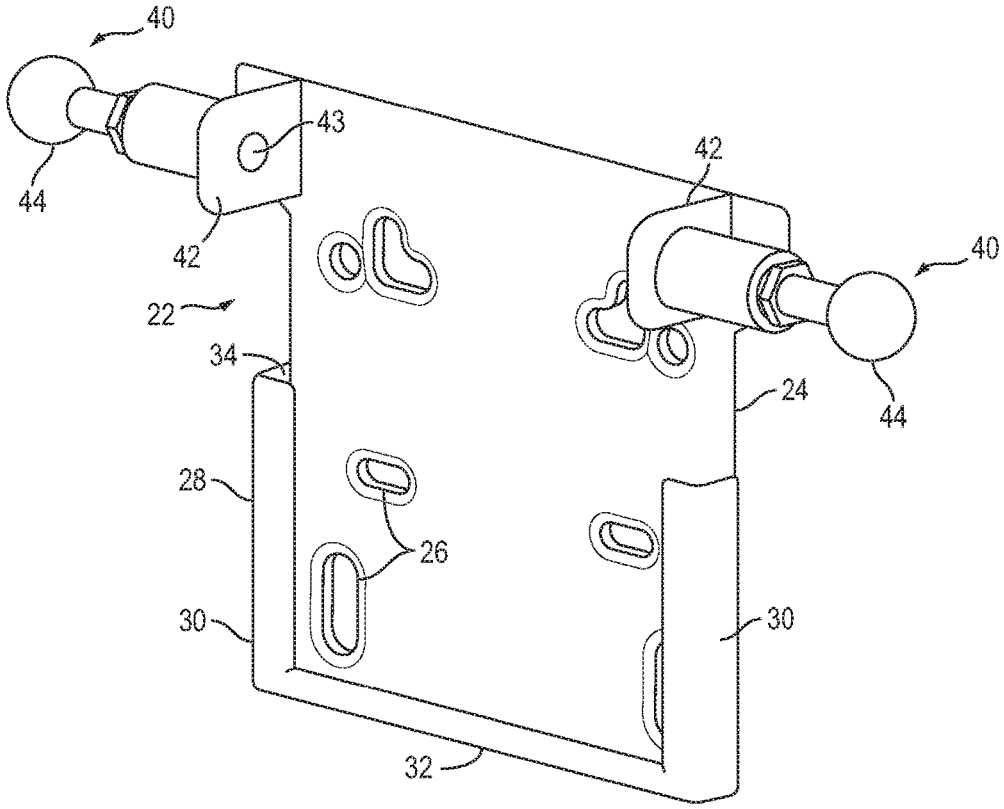
FIG. 2 is a perspective view of the adapter for engaging and securing rim attachments with basketball hoops or rims of a regulation diameter or training basketball hoops having smaller diameters.
Figure 3:
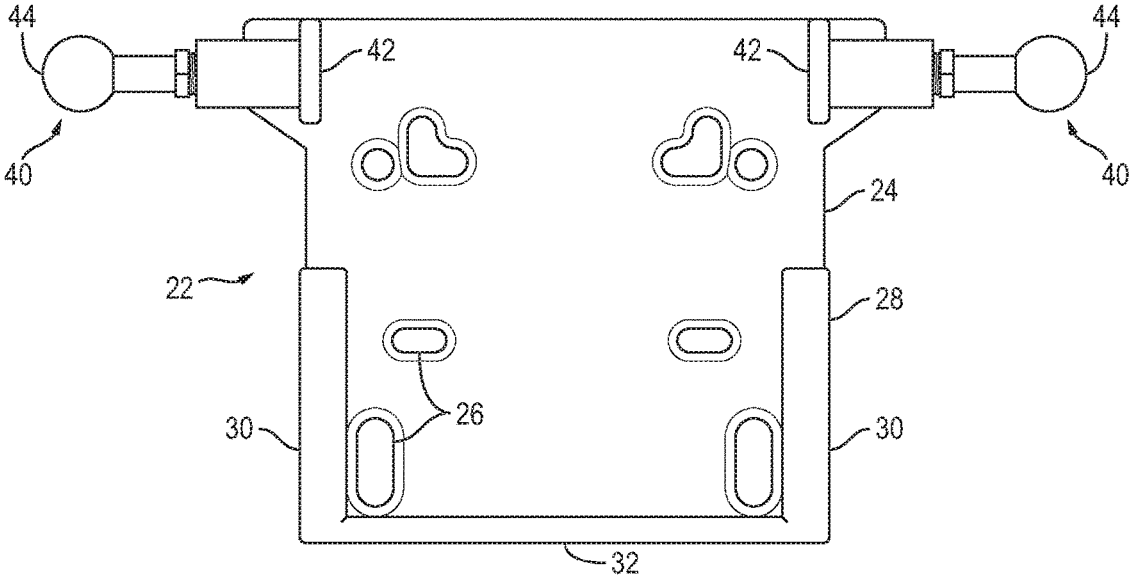
FIG. 3 is a front view of the adapter of FIG. 2.

Referring additionally to FIGS. 2-3, a rectangular sleeve 28 is formed at the bottom of the bottom of the adapter baseplate. The sleeve has two vertical sides 30 and a horizontal side 32. The sleeve 28 is attached to the baseplate 24 by, for example, welding it to the attachment plate. As best seen in FIG. 2 the sleeve forms a pocket spaced apart from the attachment plate 24 into which the base plate of the rim attachment 11 can be inserted. The separation of the pocket 28 from the adapter plate should be wide enough to accept the rim attachment base plate but not so wide as to create a loose fit.

Figure 11:
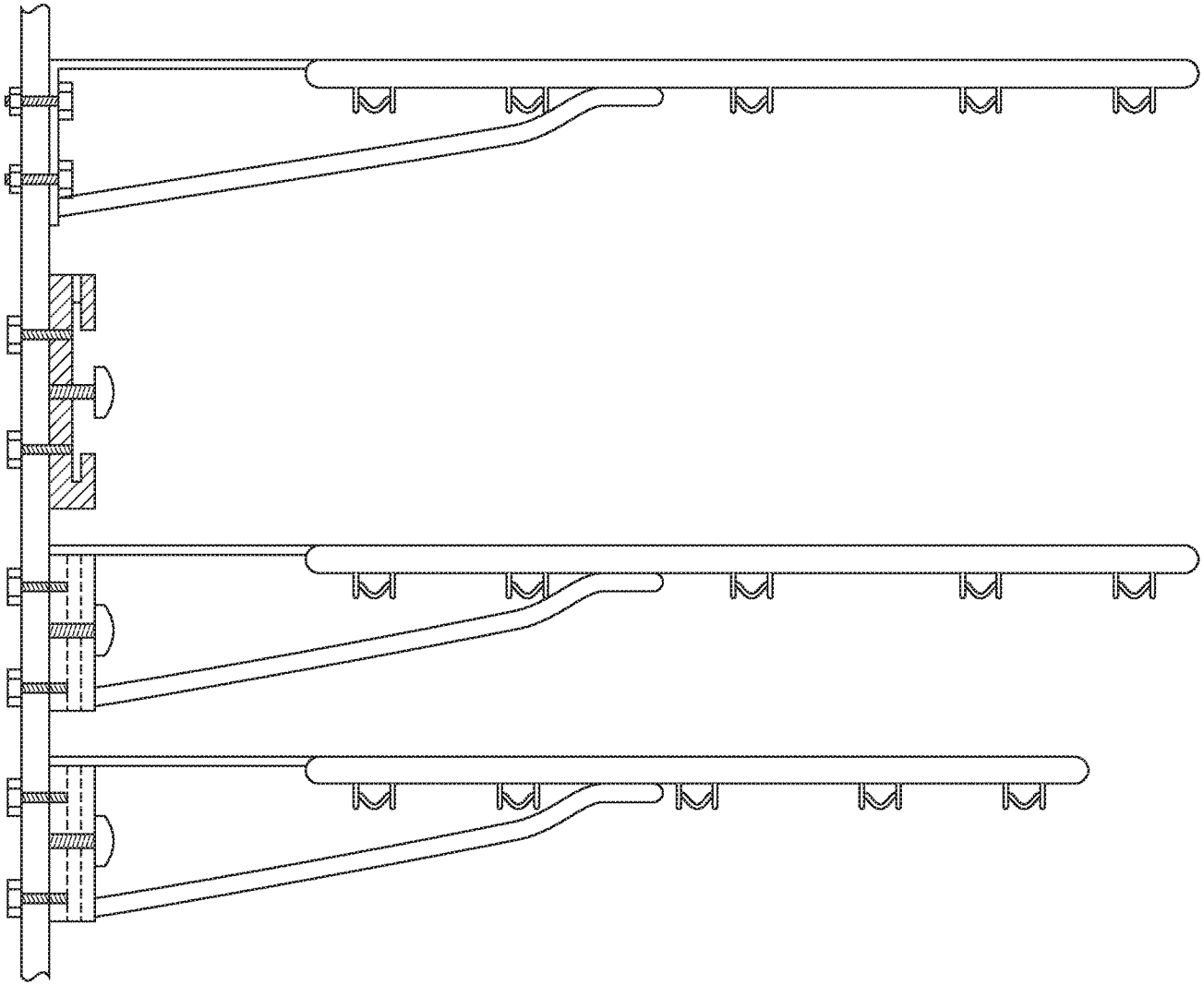
FIG. 11 illustrates illustrative dimension for the apparatus of the present invention.

Spring loaded locking pin assemblies 40 are mounted at the top left and right of the attachment plate 24. Locking pin assemblies are mounted to locking pin supports 42 that can be formed in the attachment plate such as by welding. Locking pin supports have openings 43 for the locking pins to enter and exit. The pins 46 are shown withdrawn in FIGS. 1-5 but shown extended in FIG. 6. By twisting the handles 44 and pulling the handles of the locking pin assemblies the pins retract into the locking pin assemblies. With a ½ turn of the handles, spring force forces the locking pins (See FIGS. 6, 9, 11) outwardly to lock in and support the tops of the adapter base plate.

Figure 4:
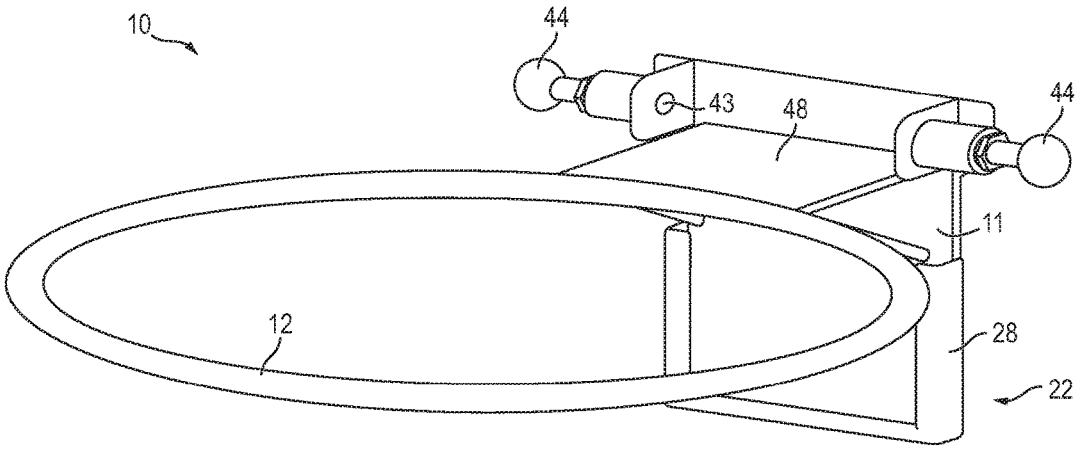
FIG. 4 illustrates the adapter and rim attachment of FIG. 3 in the attached mode.
Figure 5:
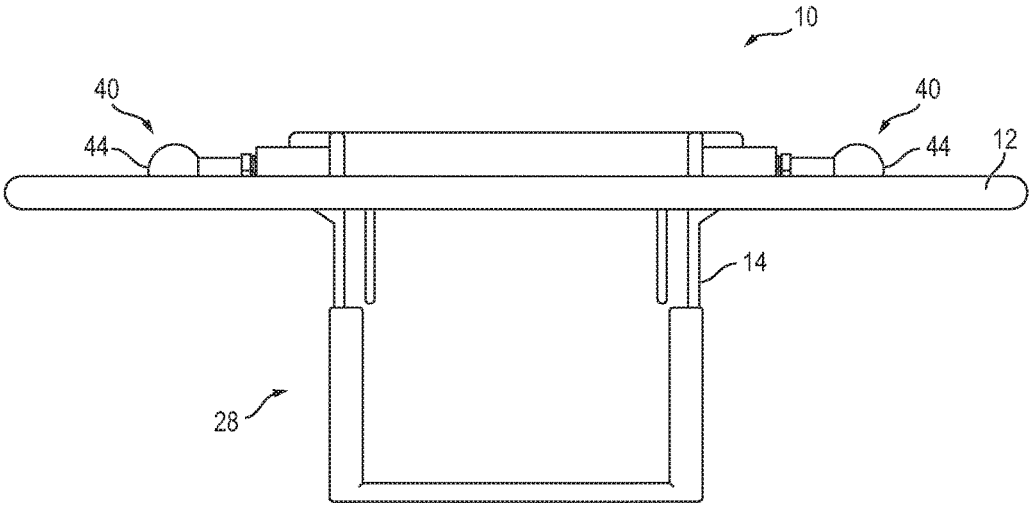
FIG. 5 is a front view of the adapter and rim attachment of FIG. 4.

FIGS. 4 and 5 show the basketball training apparatus 10 with the rim attachment 11 inserted within the adapter 22. Note that the locking pin apparatus is set to have the locking pins with drawn when the rim is inserted so as not to block the insertion of the rim attachment and pin stops. Bracket 48 secures the rim 12 to the base plate 14 along with supports 16.

Figure 6:
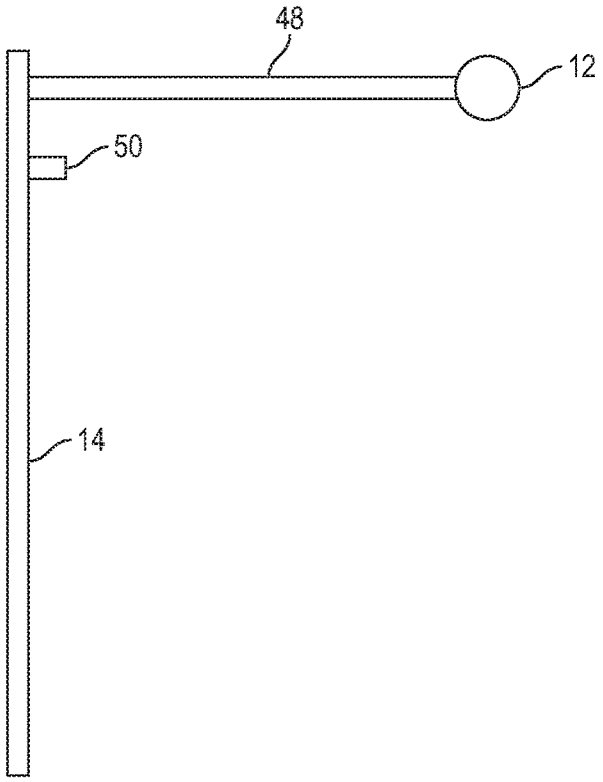
FIG. 6 is a side view of the rim and rim attachment showing a rim stop in accordance with the present invention.
Figure 7:
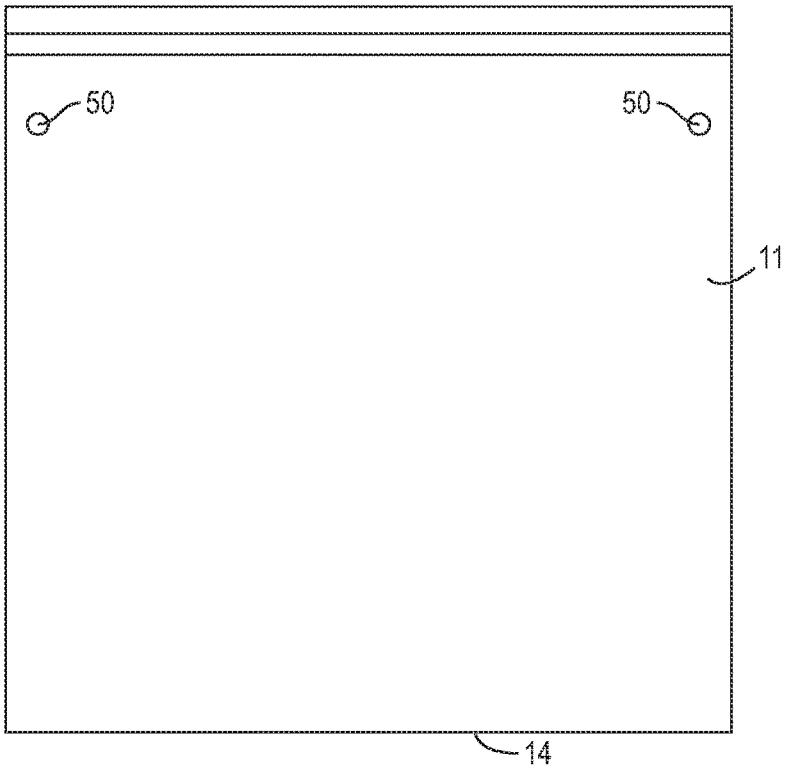
FIG. 7 is a front view of the rim attachment of FIG. 7 showing both pin stops

The pin stops are an important feature of the invention. Referring to FIGS. 6 and 7 pin stops are mounted on both sides of the rim attachment 11. A pin or rim stop 50 as attached, by welding for example, at the top of the attachment plate 14 slightly below the bracket 48 and rim 12 of the basket. The diameter of a regulation rim is ⅝". There are two pin stops 50 one on each side of the attachment plate. It is to be noted that the pin stops may have other shapes such as square or rectangular cross sections.

Figure 8:
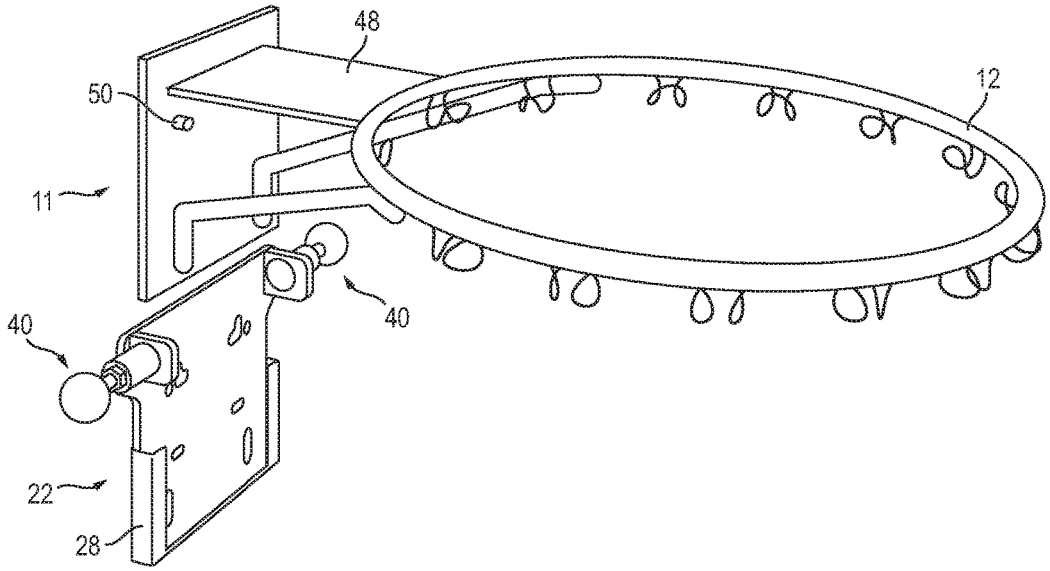
FIG. 8 is a perspective view of the adapter and rim attachment before engagement which illustrates both the locking pin apparatus and the pin stops

FIG. 8 is a perspective view of the rim attachment 11, showing both of the pin stops 50, prior to being inserted within the adapter 22. Of course the lock pin apparatus 40 must be in a position with the pins 46 withdrawn to allow the baseplate with the pin stops 50 to slide into place within the sleeve 28.

Figure 9:
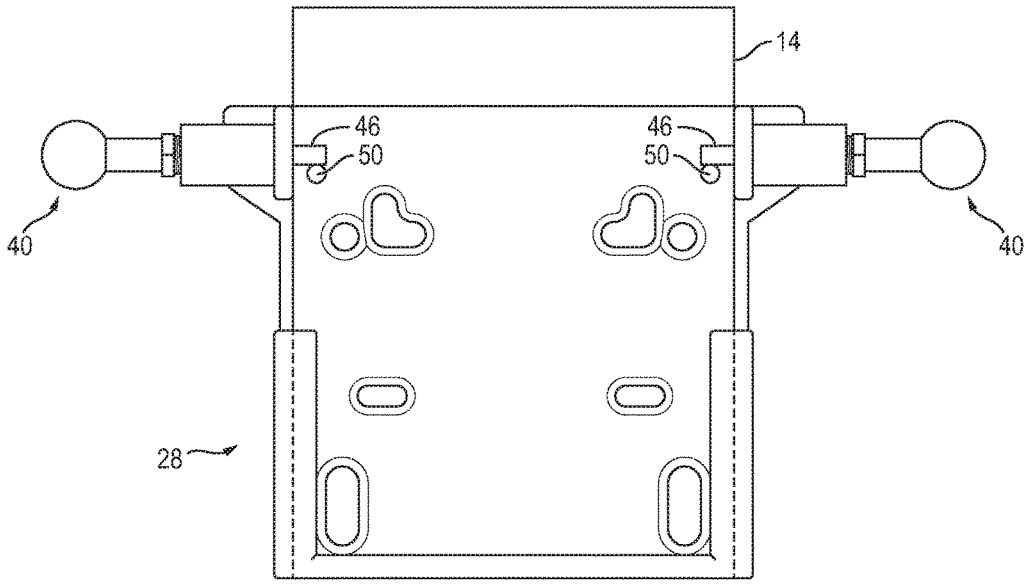
FIG. 9 shows the base plate of the rim attachment engaged within the adapter and illustrating the relationship between the locking pins when in an outward state and with the pin stops directly below and engaging the locking pins to prevent vertical motion of the rim attachment.
Figure 10:
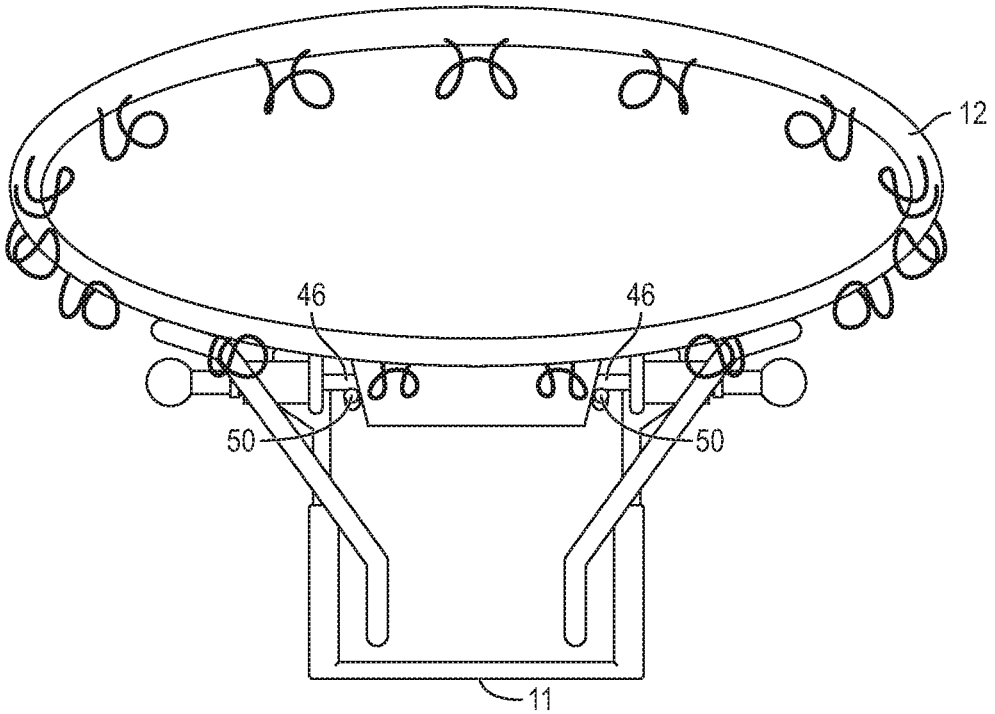
FIG. 10 is a front elevation view of the adapter and rim attachment of FIG. 9 after engagement.

FIGS. 9 and 10 show the rim attachment secured within the adapter with the locking pins 46 extended to engage the top of the rim attachment plate 14. It can be seen that the locking pin stops 50 are beneath and in contact with the locking pins 46. This engagement prevents any vertical motion by the rim attachment during use and provides for a very stable arrangement over long periods of use.

It should be apparent that replacing a rim attachment with a rim attachment having a different diameter can be done quickly and easily. Lower the rim then withdraw the locking pins into the locking pin apparatus and slide the rim attachment bracket upwardly out of the adapter sleeve. To insert another rim with a different diameter the process is repeated. The locking pins are withdrawn and the new rim is slid into the adapter sleeve. The locking pins are then released by turning knob 44 which causes the spring force within apparatus 40 to extend the pins outwardly to secure the top of the rim attachment plate and to engage the pin stops from below.

It should be noted that if the basketball rim and backboard are provided with a pivoted plate to prevent shattering the backboard if a player grabs the rim after a dunk, the adapter described herein can be attached to the pivoted plate instead of the backboard.

Also, it should be evident that any number of quick release locking pins could be utilized. However, locking pins can have different geometries such as rectangular and square cross sections. What is important is that the locking pins or their equivalent can be withdrawn or released easily by a coach or user.

Figure 12A:
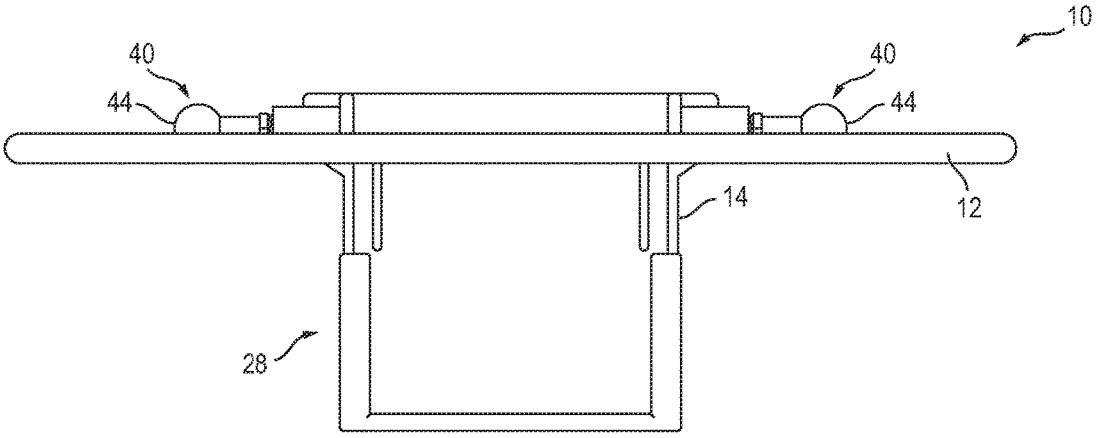
FIG. 12A is a plan view of the invention illustrating a standard 18 inch diameter rim.
Figure 12B:
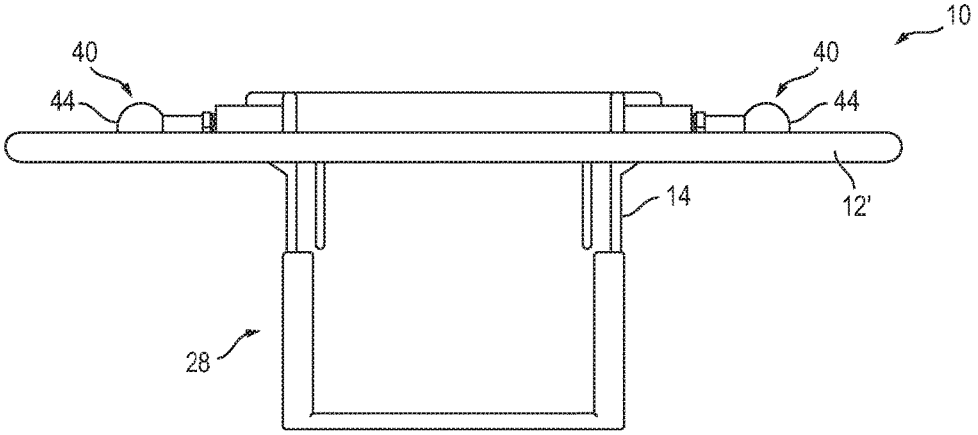
FIG. 12B is a plan view of the invention illustrating a smaller 16 inch diameter rim.
Figure 12C:
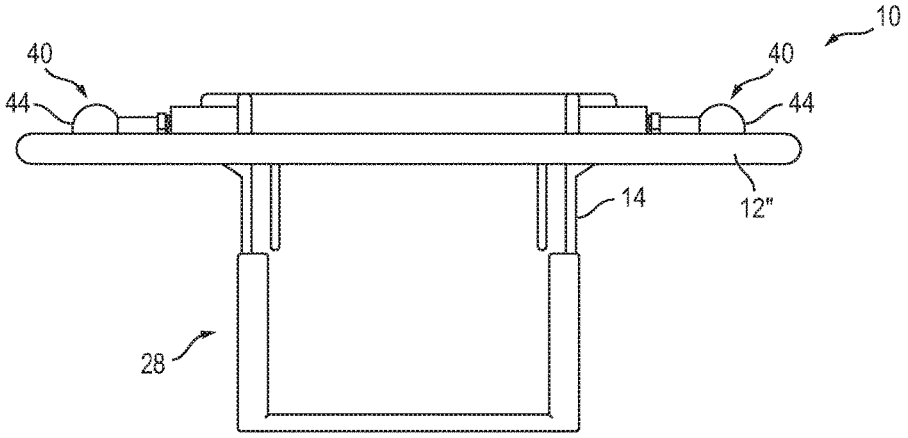
FIG. 12C is a plan view of the invention illustrating a smaller 14 inch diameter rim.

FIGS. 12A, 12B and 12C illustrate and compare different rim sizes. In FIG. 12A the rim 12 mounted to the rim attachment 14 has a standard 18 inch diameter rim. FIG. 12B illustrates a rim 12' with a 16 inch diameter mounted to rim attachment 14. FIG. 12C illustrates a rim 12" with a 14 inch diameter mounted to rim attachment 14. Except for the rim diameters the rim assemblies in these three figures appear identical to a shooter as explained above.

What is claimed is:

1. An apparatus for improving the accuracy of a basketball shooter by use of a plurality of interchangeable rim assemblies of differing diameters, said apparatus comprising:

a basketball backboard;

an adapter secured to said basketball backboard, said adapter comprising:

a substantially flat rectangular or square base plate having a top, bottom and sides, a sleeve extending from said sides and bottom of said substantially flat rectangular or square base plate; and a pair of locking pin assemblies comprising locking pins each of which is mounted proximate the top of said substantially flat rectangular or square base plate wherein said locking pins are spring-loaded and withdrawable toward said sides of said substantially flat rectangular or square base plate and which selectively extend away from said sides of said substantially flat rectangular or square base plate; the locking pins being withdrawn when a rim assembly is either vertically removed or inserted, thus allowing rim assemblies of differing diameters to be interchanged and secured within said sleeve; and wherein said plurality of interchangeable basketball rim assemblies each comprising:

regulation basketball rims of varying diameters, each basketball rim assembly comprising a bracket to which a rim is attached orthogonally thereto;

each bracket having a pair of pin stops positioned below said rim, each bracket being sized to slide vertically over said substantially flat rectangular or square base plate and to frictionally fit within and be captured by said sleeve, said pin stops being positioned on each of said bracket such that when each bracket is inserted within said sleeve, said pins extend from the sides of said substantially flat rectangular or square base plate to prevent said bracket from being removed or dislodged from said sleeve.

2. The apparatus of as in claim 1 wherein the locking pins have a circular cross-section.

3. The apparatus of claim 1 wherein the pin stops have a circular cross-section.

* * * * *